United States Patent [19]

Ahlgrim et al.

[11] 4,268,404

[45] May 19, 1981

[54] ADDITIVE FOR USE IN METAL WORKING

[75] Inventors: Michael Ahlgrim, Erftstadt; Gerhard Mietens, Hürth-Efferen; Franz-Josef Dany; Joachim Kandler, both of Erftstadt, all of Fed. Rep. of Germany

[73] Assignee: Hoechst Aktiengesellschaft, Fed. Rep. of Germany

[21] Appl. No.: 93,895

[22] Filed: Nov. 13, 1979

[30] Foreign Application Priority Data

Nov. 20, 1978 [DE] Fed. Rep. of Germany ..... 2850244

[51] Int. Cl.[3] ..... C10M 1/10; C10M 3/02; C10M 3/04; C10M 5/04

[52] U.S. Cl. ..... 252/25; 252/49.3; 252/49.8; 252/49.9; 252/74; 423/305; 423/307

[58] Field of Search ..... 252/25, 49.3, 74, 75, 252/110, 523; 71/33, 34, 35, 36; 423/305, 307

[56] References Cited

U.S. PATENT DOCUMENTS

| | | | |
|---|---|---|---|
| 2,008,939 | 7/1935 | Tufts | 252/49.3 |
| 2,432,784 | 12/1947 | Miller | 252/49.3 |
| 2,999,814 | 9/1961 | Laug | 252/49.3 |
| 3,186,945 | 6/1965 | Graue | 252/25 |
| 3,645,674 | 2/1972 | Heymer | 423/305 |
| 3,653,821 | 4/1972 | Heymer | 423/305 |
| 3,723,074 | 3/1973 | Sears | 423/305 |
| 3,775,315 | 11/1973 | Smith | 423/305 |
| 3,978,195 | 8/1976 | Schrödter | 423/305 |

*Primary Examiner*—Dennis L. Albrecht
*Attorney, Agent, or Firm*—Connolly & Hutz

[57] ABSTRACT

The invention relates to a long chain ammonium polyphosphate and its use as an effective additive in lubricants and/or coolants for metal working under extremely high pressures and temperatures. The polyphosphate chain preferably contains 50 to 1000 phosphorus atoms. Up to 20% of the ammonium groups are replaceable by hydrogen. The additive is preferably added to the lubricant/coolant in a proportion of 0.1 to 30 weight %.

5 Claims, 1 Drawing Figure

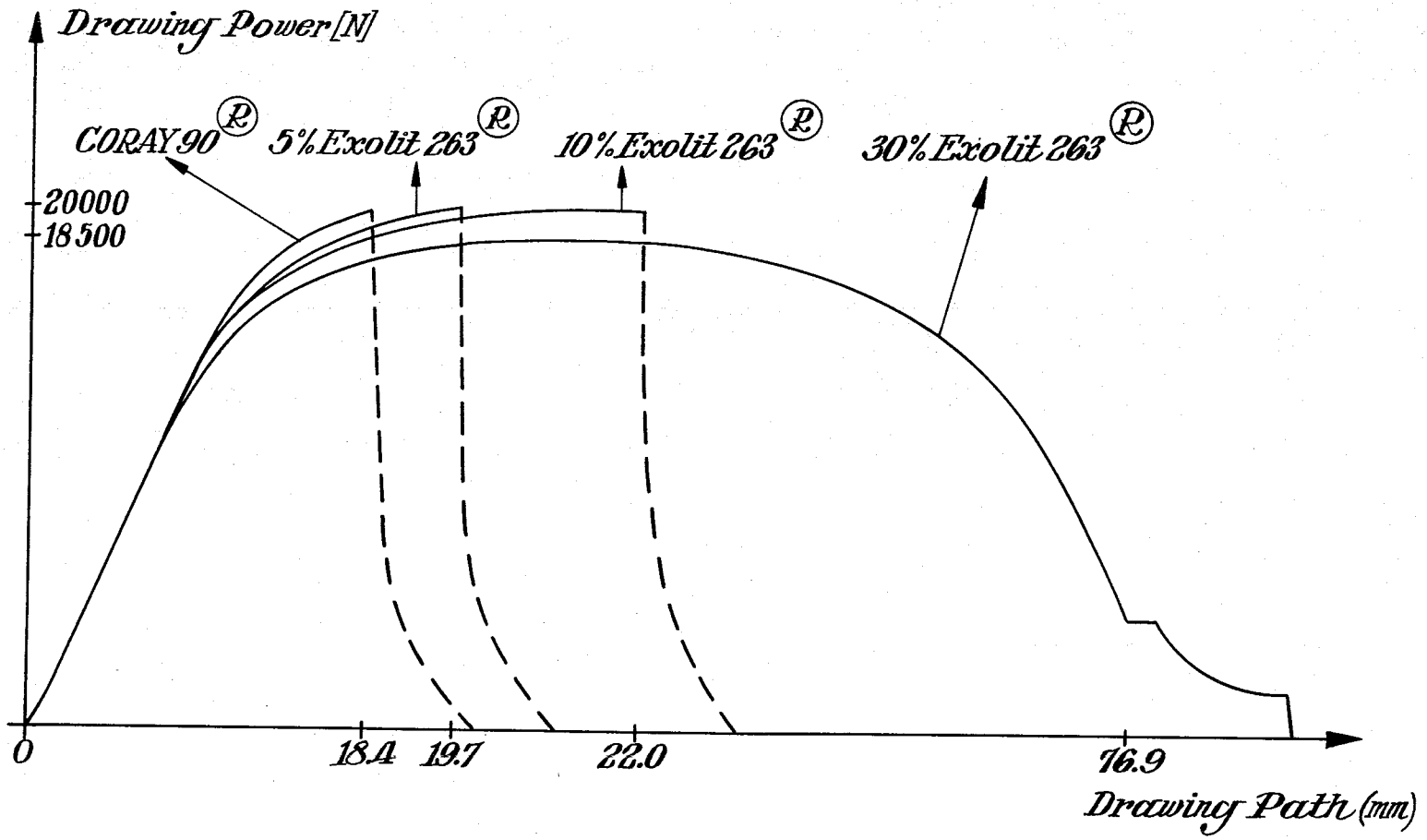
Drawing Power [N]
20000
18500
CORAY 90 ®
5% Exolit 263 ®
10% Exolit 263 ®
30% Exolit 263 ®
0
18.4
19.7
22.0
76.9
Drawing Path (mm)

ADDITIVE FOR USE IN METAL WORKING

This invention relates to a phosphate-based lubricant and coolant additive suitable for use in metal working. The additive of the present invention is particularly suitable for use in working metal under extremely high pressure or temperature, e.g. in milling, extruding, drawing or rolling operations under hot or cold conditions.

It is known that lubricants and coolants which reduce the frictional resistance between workpiece and tool can be used as wear-reducing and production-improving agents. These are lubricants and coolants which commonly consist of lubricating oils which have wear- and corrosion-retarding additives admixed therewith.

German Patent Specification "Offenlegungsschrift" No. 16 44 875, for example, describes and aqueous coolant which is admixed with 0.1 to 20 weight % of a polyoxyalkyleneglycol polyester of a dimeric fatty acid. As has been found, the organic constituent of this coolant is liable to undergo oxidation and/or evaporation under the enormous heat which is evolved spotwise and which avoids the build-up of a sliding layer.

Lubricants containing iron and/or zinc pyrophosphates have been disclosed in German Patent Specification "Offenlegungsschrift" No. 16 44 908.

German Patent Specification "Offenlengungsschrift" No. 20 48 537 describes a lubricant for use at high temperatures. The lubricant is based on a binder and solvent which have salts of ortho- and/or polyphosphoric acid with sodium and/or potassium and/or zinc and/or aluminum and/or boron admixed therewith.

Austrian Patent No. 278,233 describes the preparation of a lubricant/coolant by admixing it with an orthophosphate or condensed phosphate of an alkali metal or metal oxide.

In other words, it is known art that inorganic and organic phosphorus compounds can be used as additives in lubricating oils or water. The use of orthophosphoric acid and polyphosphoric acid, respectively, as an additive in lubricating oils, and particularly in water, has however been found to entail serious corrosion phenomena which call for treatment with an alkali metal hydroxide or amine so as to be reduced to some extent. Needless to say, the step of neutralizing the free acid has adverse effects on lubrication, and the bases added are indeed liable to produce an undesirable thickening effect so that the cooling efficiency is considerably reduced.

Phosphoric acid esters are additives permitting the production of neutral homogeneous lubricants and coolants. Experience has however shown that correlation exists between the lubricating effect and phosphorus content of the lubricant/coolant, of which the efficiency is the better the higher the content of phosphorus therein. The useful phosphoric acid esters, however, contain at most 13.4 weight % of phosphorus and therefore permit the production of lubricants/coolants with a limited content of phosphorus only (cf. German Patent Specification "Auslegeschrift" No. 21 45 296).

In other words, the lubricants and coolants used heretofore are in need of improvement inasmuch as they do not permit the tool to be cooled as satisfactorily as would be desirable. On the other hand, metal oxide/-phosphate-glasses are liable to sinter together on the workpiece from which they must be removed later by etching treatment with an acid.

It is therefore an object of the present invention to provide an additive for use in metal working, the additive permitting improved high pressure and wear-retarding properties to be imparted to lubricating oils and water.

To this end, the invention provides for the additive to be added to the lubricant/coolant to comprise a long chain ammonium polyphosphate, especially a polyphosphate of the following general formula:

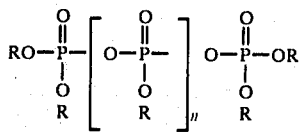

in which n stands for a whole number of 50 to 1000, preferably 300 to 800, and R stands for an ammonium group.

Up to 20%, preferably up to 5%, of the ammonium groups in the ammonium polyphosphate are replaceable by hydrogen.

It is possible for the present ammonium polyphosphate additive to be used in the form of a liquid, suspension or paste which is added to the lubricating oil or water.

The ammonium polyphosphate is added to the lubricant/coolant in proportions of 0.1 to 30 weight %, preferably 2 to 10 weight %.

The present ammonium polyphosphate additive can be used in admixture with surfactants and/or foam inhibitors and/or dyestuffs and/or corrosion inhibitors and/or phosphate esters.

Useful lubricant oil bases comprise mineral lubricating oils, such as paraffin-basic or naphthene-basic distillate oils with a viscosity e.g. within the range 6 and 60 centistokes at 60° C. and/or synthetic lubricating oils, such as polyolefins and/or ester oils and/or polyoxyalkylenes.

The useful surfactants comprise more specifically non-ionic surfactants, such as polyoxyethylene stearate or polyoxyethylene monobutylether, the surfactants being used is proportions of 1 to 20 weight %, based on the lubricants/coolants.

The useful foam-inhibitors should be selected from siloxanes, e.g. polymethylsiloxane, and added to the lubricant and/or coolant in quantities of 5 to 25 ppm. Benzotriazol and ethylsuccinic acid are suitable corrosion inhibitors which should conveniently be added in quantities of up to about 200 ppm.

By the additional use of a phosphate ester, e.g. the ammonium salt of a mixture of mono- und dioleylphosphoric acids or di-n-propyldithiophosphoric acid or tricresyl phosphate in proportions of 0.01 to 10 weight %, based on the weight of the lubricant/coolant, it is possible synergetically to improve the efficiency of the ammonium polyphosphate as an additive in lubricating oils.

In hot metal working, use should preferably be made of an ammonium polyphosphate with an average chain length n=500 to 1000, more preferably n=600 to 800, which is obtainable e.g. by the process described in German Patent Specification No. 23 30 174.

In cold metal working, where it is highly desirable for the workpiece and tool to be effectively cooled, it is good practice to use as the additive an ammonium polyphosphate with an average chain length n=50 to 400, preferably n=300 to 400, which is obtainable e.g. by the process described in German Patent Specification No. 17 67 205.

The following Examples are intended further to illustrate the properties of ammonium polyphosphate as an additive to lubricants and/or coolants. Needless to say, the Examples are in no way intended to limit the invention thereto; this is more especially true concerning the admixture of additional addends permitting the properties of the lubricant or coolant to be further improved.

The lubricants and coolants described in the following Examples were tested in accordance with DIN specification No. 51 350 (DIN stands for German Industrial Standard) in a Shell-four-ball apparatus and with the use of a Reichert friction wear-balance.

EXAMPLE 1

2.5 parts by weight of ammonium polyphosphate was suspended in 97.5 parts by weight of water. As described in German Patent Specification 17 67 205, the ammonium polyphosphate was annealed at 330° to 340° C. It had an average chain length n=300 to 400 and a particle size smaller than 63 microns.

The test result obtained with the use of the friction wear-balance is indicated in the following Table 1.

COMPARATIVE EXAMPLE 1*a*

3.0 parts by weight phosphate ester of a commercial product based on phenol with 6 ethylene oxide units was mixed with 97.0 parts bei weight of water.

The test result on the friction wear-balance is indicated in the following Table 1.

COMPARATIVE EXAMPLE 1*b*

The lubricating efficiency of pure water was determined. The test result on the friction wear-balance is indicated in the following Table 1.

TABLE 1

| No. | Additive (wt. %) | Lubricating base | Noise range (m) | Surface pressure (bars) |
|---|---|---|---|---|
| 1 | 2.5 ammonium polyphosphate | Water | 3 | 577 |
| 1a | 3.0 phosphate ester | Water | 25 | 161 |
| 1b | none | Water | 100 | 72 |

EXAMPLE 2

5 parts by weight of ammonium polyphosphate was suspended in 95 parts by weight of naphthene-basic oil (CORAY 90; this is a registered Trade Mark of ESSO AG). The ammonium polyphosphate which had a chain length n=300 to 400 and a particle size of less than 63 microns, was made as described in German Patent Specification No. 17 67 205.

The test result obtained with the Shell-four-ball apparatus is indicated in the following Table 2.

COMPARATIVE EXAMPLE 2*a*

The lubricating efficiency of pure naphthene-basic oil (CORAY 90) was determined.

The test result obtained with the Shell-four-ball apparatus is indicated in the following Table 2.

EXAMPLE 3

2.5 parts by weight of ammonium polyphosphate (the same as that used in Example 2) and 2.5 parts by weight of a phosphate ester based on oleyl alcohol with 5 ethylene oxide units were dissolved in 95 parts by weight of naphthene-basic oil (CORAY 90).

The test result obtained with the Shell-four ball apparatus is indicated in the following Table 2.

COMPARATIVE EXAMPLE 3*a*

5 parts by weight of a phosphate ester based on oleyl alcohol with 5 ethylene oxide units was dissolved in 95 parts by weight of naphthene-basic oil (CORAY 90).

The test result obtained with the Shell-four-ball apparatus is indicated in the following Table 2.

TABLE 2

| No. | Additive (wt. %) | Lubricating base | Good load (N) | Welding load (N) |
|---|---|---|---|---|
| 2 | 5 Ammonium polyphosphate | CORAY 90 | 2200 | 2400 |
| 2a | None | CORAY 90 | 1400 | 1500 |
| 3 | 2.5 Ammonium polyphosphate 2.5 Phosphate ester | CORAY 90 | 3200 | 3400 |
| 3a | 5 Phosphate ester | CORAY 90 | 1600 | 1800 |

EXAMPLE 4

Deep drawing tests were made as described by Erichsen. The test results obtained are graphically plotted in the accompanying diagram. Drawing path was significantly increased by addition of ammonium polyphosphate. Suspension of 30 parts by weight of ammonium polyphosphate (EXOLIT 263; this is a registered Trade Mark of Hoechst AG) in 70 parts by weight of naphthene-basic oil (CORAY 90) permitted wire to be drawn without break at drawing ratio of 2.27 (diameter of blank=75 mm; diameter of drawing die=33 mm). With the use just of CORAY 90, break did occur after 18.4 mm at drawing ratio of 2.27.

EXAMPLE 5

100 parts by weight of ammonium polyphosphate (EXOLIT 263) was suspended with thorough agitation in 80 parts by weight of naphthene-basic oil (CORAY 90) and the suspension was heated to 100° C. Next, 5 parts by weight of an oxy-alcohol (GENAPOL-X-050; this is a registered Trade Mark of Hoechst AG) and 5 parts by weight of an oxy-paraffin (Wax OP, a commercially available product of Hoechst AG, Frankfurt/Main, Federal Republic of Germany) were added with agitation. The whole was allowed to cool to give a grease. The test result obtained with the use of a friction wear-balance indicated a surface pressure of 3.266 bars at noise range=0 m. The test was made on the liquid paste at 65° C.

We claim:

1. An oil-based composition for use in metal working containing as an additive an ammonium polyphosphate of the general formula

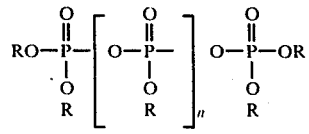

in which n is a whole number of 50 to 1000 and R stands for an ammonium group, the amount of said additive being sufficient to impart to said composition improved high pressure and wear-retarding properties.

2. An oil-based composition as claimed in claim 1, wherein up to 20% of the ammonium groups of the ammonium polyphosphate additive are replaced by hydrogen.

3. An oil-based composition as claimed in claim 1, wherein the additive is contained in the form of a suspension or paste in a lubricating oil.

4. An oil-based composition as claimed in claim 1, wherein the additive is contained in a proportion of 0.1 to 30 weight %.

5. An oil-based composition as claimed in claim 1, wherein the additive is contained in admixture with at least one of the following materials: surfactants, foam inhibitors, dyestuffs, corrosion inhibitors and phosphate esters.

* * * * *